US005713407A

United States Patent [19]

Judkins

[11] Patent Number: 5,713,407

[45] Date of Patent: Feb. 3, 1998

[54] DRAPERY SYSTEM HAVING LIGHT CONTROLLING VERTICAL VANES

[76] Inventor: Ren Judkins, 46 Newgate Rd., Pittsburgh, Pa. 15202

[21] Appl. No.: 623,368

[22] Filed: Mar. 28, 1996

[51] Int. Cl.[6] ..... A47H 1/00

[52] U.S. Cl. ..... 160/89; 160/126; 160/173 V; 160/178.1 V; 160/900

[58] Field of Search ..... 160/89, 123, 126, 160/168.1 V, 173 V, 176.1 V, 177 V, 178.1 V, 900, 330, 348

[56] References Cited

U.S. PATENT DOCUMENTS

| | | | |
|---|---|---|---|
| 1,017,765 | 2/1912 | Kiefer | 160/126 |
| 2,301,047 | 11/1942 | Hendley | 160/348 |
| 2,470,422 | 5/1949 | Wright | 160/348 |
| 2,989,120 | 6/1961 | Judkins | 160/126 |
| 3,114,412 | 12/1963 | Lishman | 160/348 |
| 3,242,972 | 3/1966 | Truesdale | 160/84 |
| 3,348,603 | 10/1967 | Ford | 160/348 |
| 3,384,519 | 5/1968 | Froget | 156/65 |
| 3,527,284 | 9/1970 | Nelson et al. | 160/348 |
| 3,735,795 | 5/1973 | Broek | 160/348 |
| 3,851,699 | 12/1974 | Shapiro | 160/166 |
| 3,911,991 | 10/1975 | Malferrari | 160/348 |
| 3,975,792 | 8/1976 | Janson | 160/348 X |
| 4,053,009 | 10/1977 | Edlin | 160/348 |
| 4,069,553 | 1/1978 | Takazawa | 160/348 |
| 4,125,143 | 11/1978 | Pape et al. | 160/348 |
| 4,406,318 | 9/1983 | Cukierski | 160/126 |
| 4,466,476 | 8/1984 | Fairbanks | 160/330 |
| 4,546,809 | 10/1985 | Hadfield | 160/126 |
| 4,915,153 | 4/1990 | Toti | 160/84.1 |
| 4,974,656 | 12/1990 | Judkins | 160/84.1 |
| 5,109,910 | 5/1992 | Tortorella et al. | 160/900 X |
| 5,191,922 | 3/1993 | Wade | 160/330 X |
| 5,313,999 | 5/1994 | Colson et al. | 160/121.1 |
| 5,339,882 | 8/1994 | Judkins | 160/84.1 |
| 5,392,833 | 2/1995 | Ohanesian | 160/168.1 V X |
| 5,586,595 | 12/1996 | Takizawa et al. | 160/330 |

FOREIGN PATENT DOCUMENTS 56179 4/1991 Germany .

*Primary Examiner*—Anthony Knight
*Assistant Examiner*—Bruce A. Lev
*Attorney, Agent, or Firm*—Buchanan Ingersoll, P.C.

[57] ABSTRACT

A light controllable drapery system has a first track from which a drapery is hung and a parallel, second track from which vertical vanes are hung. Both the drapery and the vertical vanes are suspended from carriers which are sliceable along their respective tracks. At least one connector connects a carrier on the first track to a carrier on the second track to enable carriers on the first track to move concurrently with carriers on the second track. A pusher is provided on each vane which pushes the drapery along the drapery track when the vanes are moved from an open position to a closed position so that the drapery does not become entangled between the vanes during that movement.

22 Claims, 5 Drawing Sheets

DRAPERY SYSTEM HAVING LIGHT CONTROLLING VERTICAL VANES

FIELD OF INVENTION

The invention relates to draperies used for window coverings and particularly to a drapery used in combination with a window blind.

BACKGROUND OF THE PRIOR ART

Draperies and vertical blinds are well-known window coverings. Vertical blinds have a series of vanes hung from carriers that are supported by a track. The vanes are slidable along the vertical track and can be rotated between an open, see through position and a closed position. Traditionally, vertical blinds are used as coverings for both windows and sliding glass doors. The art normally does not use vertical blinds in combination with drapes because adjacent drapery material tends to interfere with the rotation of the vanes.

Draperies are available in a variety of materials. Commonly a designer will provide a sheer curtain which permits some passage of light in combination with a heavier drapery through which light cannot pass. Consequently, the owner of that drapery system may have a completely open window, a window covered by the sheer which allows for daytime privacy, some passage of light and a view of the outside; or a window covered by the heavier drapery and a sheer which allows night time privacy, little passage of light, and no view of the outside.

Another type of window covering which has gained in popularity is disclosed in U.S. Pat. No. 5,313,999 to Colson et al. That window covering has first and second parallel sheer fabric sides and a plurality of opaque or somewhat opaque vanes extending between the sheer fabric sides. The vanes are angularly controllable by relative movement of the sheer fabric sides. Like the combination of a sheer fabric and an opaque fabric this system allows the user to have a fully open window, a sheer covered window allowing light transmission with day time privacy and a covering providing night time privacy or room darkening. In addition it has intermediate light control of a louvered product like venetian blinds.

Fabric window coverings and draperies are often preferred by consumers over vertical blinds and venetian blinds because they have a softer appearance. However, draperies do not have the ability to control the amount of light transmitted through the window covering in a manner similar to louvered blinds like the traditional venetian or vertical blind. Several attempts have been made to provide a fabric window covering with the ability to control the amount of light entering the room. The window covering system of Colson et al. U.S. Pat. No. 5,313,999 achieves that result, however, the product is difficult to manufacture, has a limited range of fabrics it can use, has a very flat appearance when in the opaque mode and only raises up and down.

Another system is disclosed in U.S. Pat. No. 3,384,519 to Froget. The window covering disclosed there consists of two cloth layers spaced apart by movable parallel blades having each of their marginal edges heat welded to one of the movable cloth layers. With this window covering relative movement of the two cloth layers in a direction perpendicular to the blades changes the angle of the blade and thus controls the amount of light emitted through the article. Because the blades must be heat welded to the cloth layers, only thermoplastic materials can be used. Also heat welding necessarily requires a melting of some of the fibers of the material bonded, thus providing an uneven outer appearance along the heat welds and producing unwanted crimps or creases of the material which can result in fatigue failure. Furthermore, heat welding is a relatively slow process and the resulting weld is limited in strength.

In my U.S. Pat. No. 5,339,882, I disclose a window covering having a series of slats connected between two spaced apart sheets of material. The slats are substantially perpendicular to the sheets of material when the covering is in an open position. The slats are substantially parallel to the first and second sheets of material when the window covering is in a closed position. This product has many of the same limitations of the window covering disclosed by Colson.

Consequently there is a need for a window covering system which combines the vertical lines, side to side operation, and soft appearance of draperies with the light control abilities of a louvered blind. The system should be easy to install and to operate and able to be manufactured at a cost which allows the product to be sold at a competitive price.

SUMMARY OF THE INVENTION

I provide a light controllable window covering system in which there is a master carrier connected to a first drape and also to the vertical vanes. Optionally, it may be connected to another drape on the opposite side of the vertical track as the first drape. The drapery track and vertical track are parallel to one another and interconnected by the master carrier so that the vertical blind and the draperies can be traversed or stacked and unstacked together.

I prefer that the draperies be hung by pendants pivotably attached to carriers that slide along the drapery tracks. I further prefer to provide a spacer between adjacent carriers so that when the drapery system is in a fully closed, unstacked position the carriers will be equally spaced.

I also prefer to provide a tab on the vertical pleats in the drapery system. Each tab may contain a stiffening rod or opaque strip.

I also prefer to provide a pusher attached to each vertical vane near the top. The pusher extends outward from the vertical vane and pushes an adjacent tab or pleat on the drapery whenever the vertical vane is rotated a desired amount. This prevents the pleats or tabs in the drapery from becoming entangled in the vertical vanes as they are moved from a closed position to an open position.

Other objects and advantages of the invention will become apparent from a description of certain present preferred embodiments shown in the drawings.

DESCRIPTION OF THE PREFERRED EMBODIMENTS

Figure 1:
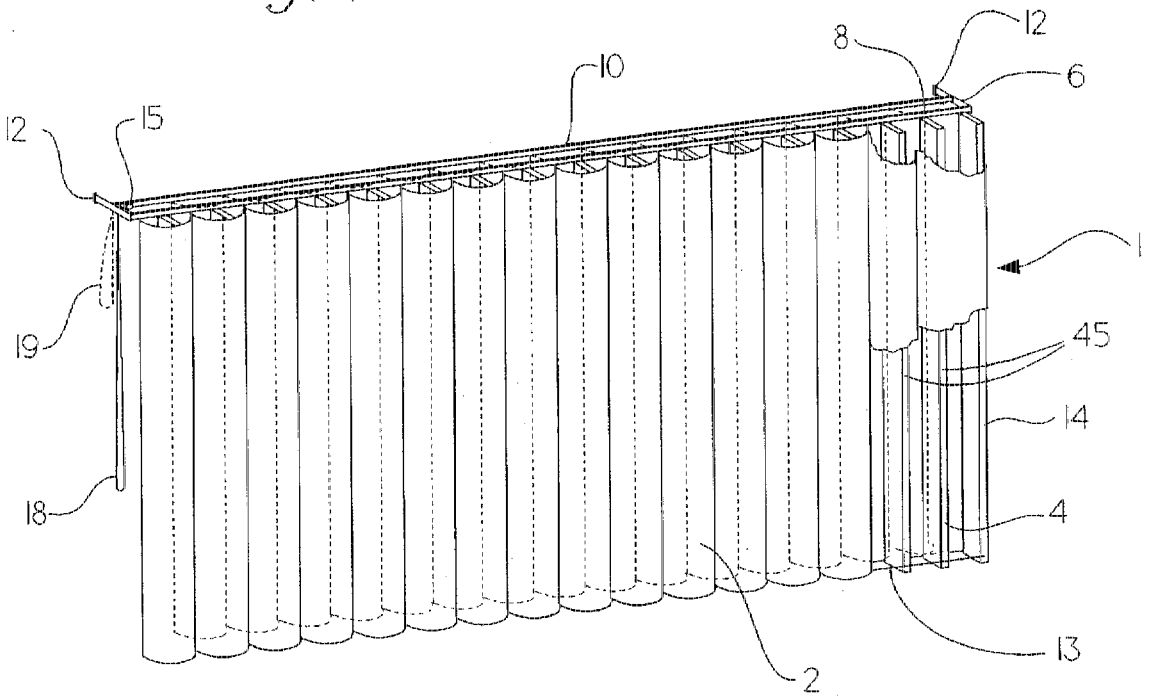
FIG. 1 is a perspective view of the present preferred embodiment of my light controllable drapery system.

A perspective view of a present preferred embodiment of my light controllable drapery system 1 is shown in FIG. 1. This system is comprised of a drapery 2 and set of vertical vanes or slats 4 hung from a master carrier 6 hung with mounting brackets 12. The master carrier contains a drapery track 8 from which the drapery 2 is hung and a vertical track 10 from which vertical vanes 4 are hung. The drapery track 8 and the vertical track 10 are generally parallel and spaced apart a sufficient distance to enable the vanes to close to a desired position relative to the drapery fabric.

Figure 7:
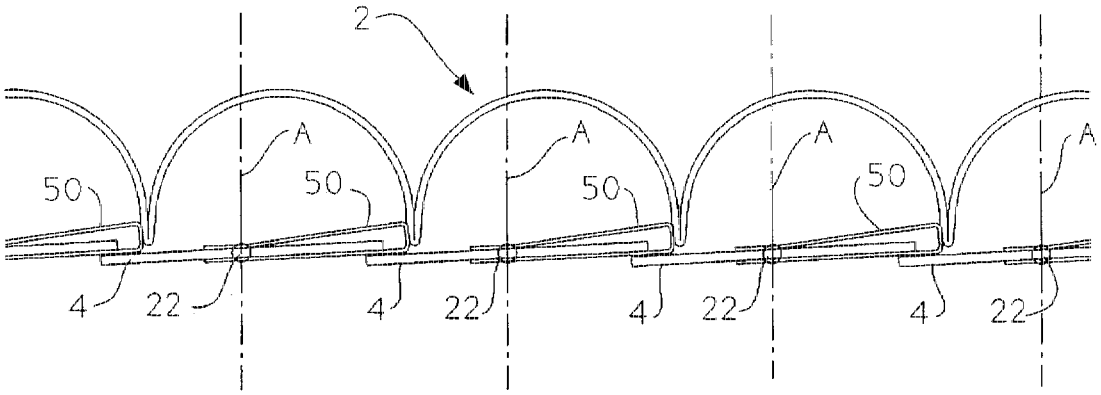
FIG. 7 is a diagram showing a first preferred positioning of the vertical vanes relative to the drapery when in a closed position.
Figure 8:
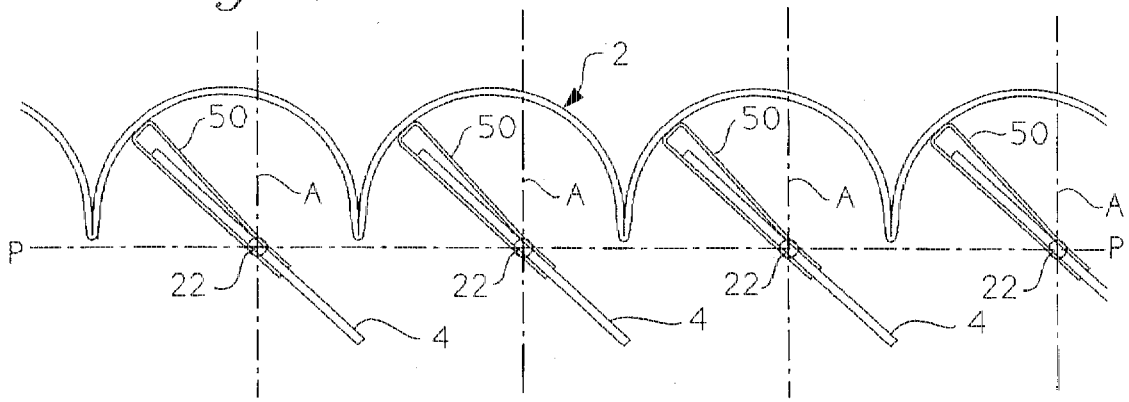
FIG. 8 is a diagram showing an intermediate position of the vertical vanes between the positions shown in FIGS. 7 and 8.
Figure 9:
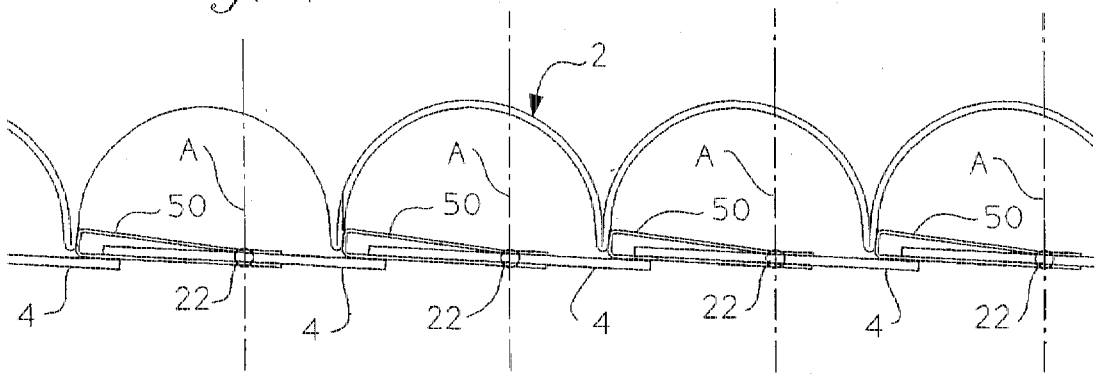
FIG. 9 is a diagram showing a second present preferred positioning of the vertical vanes relative to the drapery in a closed position opposite of FIG. 7.
Figure 12:
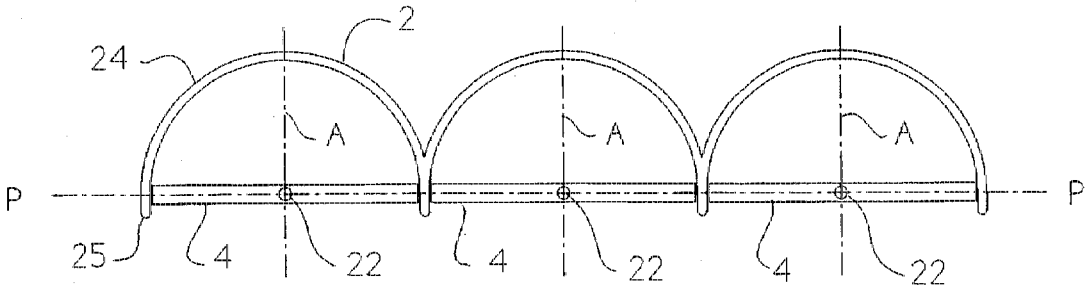
FIG. 12 is a diagram showing a third present preferred positioning of vertical vanes relative the fabric.
Figure 13:
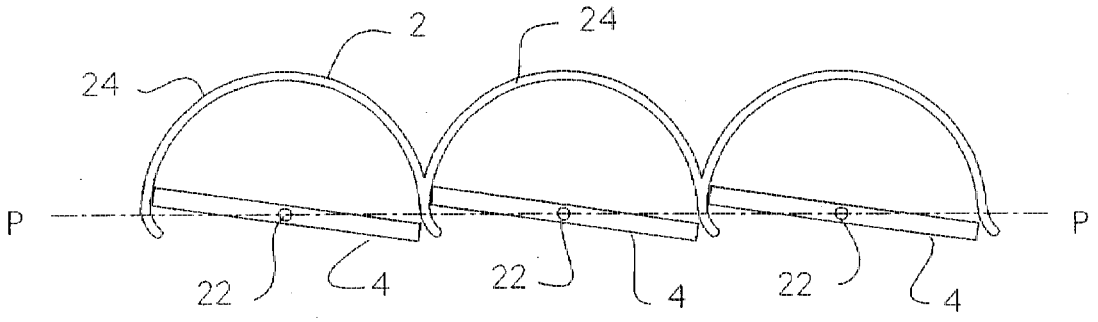
FIG. 13 is a diagram of a fourth present preferred positioning of vertical vanes relative the fabric.

As can be seen in FIGS. 7, 8 and 9 the vertical vanes 4 each rotate around an axis 22 from a fully open position where the vanes are aligned along lines A passing through the axes 22 and the drapery 2, to one of the closed positions shown in FIGS. 7 and 9. I prefer that each axis 22 be positioned relative to an adjacent pleat in the drapery so that when the vanes are in a fully open position, a line A through each vane and the drapery will bisect the pleat as shown in the embodiment of FIG. 12. There is a vertical plane indicated by the dotted line PP in FIGS. 8 and 12 which passes through at least some and preferably all of the vertical axes of the vertical vanes 4. The drapery track can be spaced from the vertical track so that all of the drapery 2 is positioned on one side of the vertical plane through line PP as in FIGS. 7, 8, and 9. Alternatively, tracks 8 and 10 can be moved closer together so that the vertical plane through line PP passes through a portion of the drapery as shown in the embodiments of FIGS. 12 and 13. When the vertical vanes 4 are rotated to a closed position in an embodiment with the spacing of FIGS. 12 and 13, a portion 25 of the pleat 24 will be trapped between the opposite ends of adjacent vanes 4.

Figure 2:
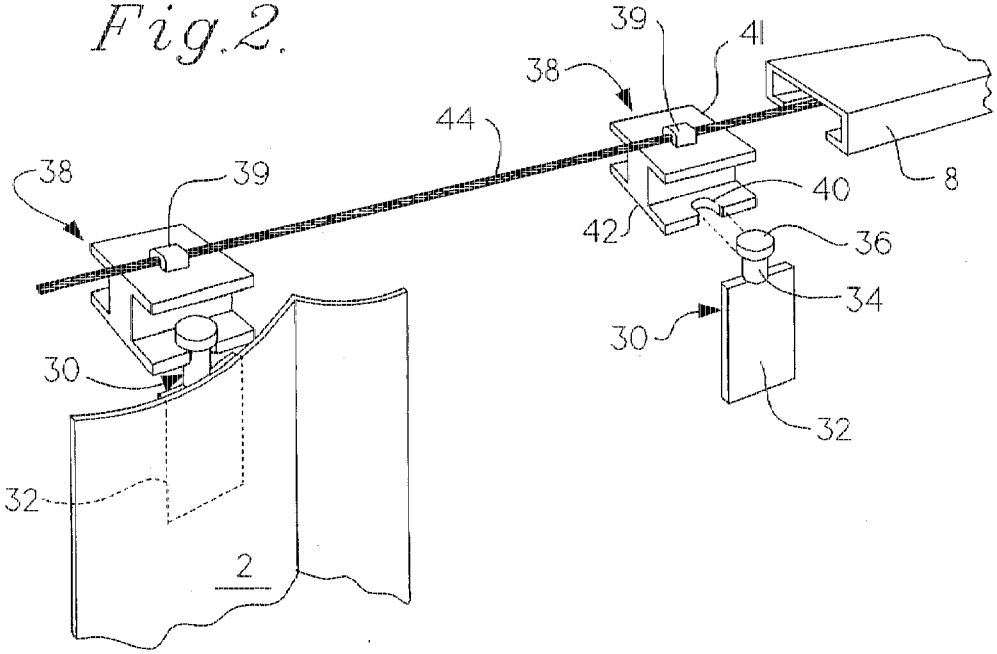
FIG. 2 is a perspective view showing a present preferred carrier and spacer cord used to hang the drapery.

I prefer to suspend the drapery from the drapery track using the system shown most clearly in FIG. 2. In this system there is a pendent 30 having a body portion 32 that is attached to the top of the drapery. A neck 34 extends from the body to hold a head 36. A slide or carrier 38 is provided to hold each pendent 30. The slide has an H-shaped cross section allowing it to slidably fit within the drapery track 8. A drapery track 8 for the drapery and a segment of drapery 2 attached to one of the pendants 30 is also shown. A mouth 40 is provided in the base 42 of the slide 38. The mouth 42 is sized to receive the neck 34 preferably through a snap fit. Head 36 is seated between the base 42 and top 41 of the slide 38. A boss 39 is provided on the top 41 of each slide. Spacer cord 44 is connected between the slides. I prefer that the spacing between all the carriers holding the drapery be the same as the spacing between the vertical vane carriers. A carrier and spacer cord system such as is shown in FIG. 2 is available from several sources. Graber sells this type of system under the trademark SLIMLINE.

Figure 4:
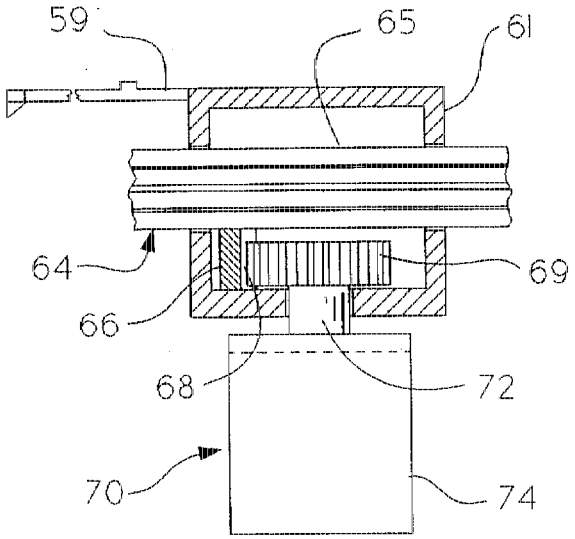
FIG. 4 is a side view partially in section of the carrier shown in FIG. 3.
Figure 3:
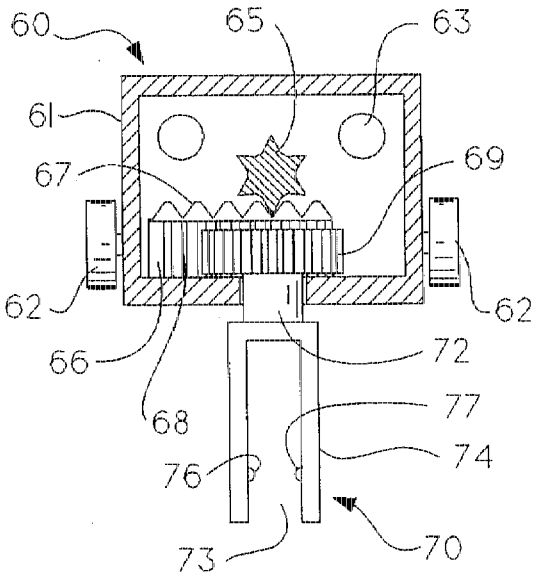
FIG. 3 is an end view partially in section showing a present preferred carrier used to hang the vertical vanes.
Figure 5:
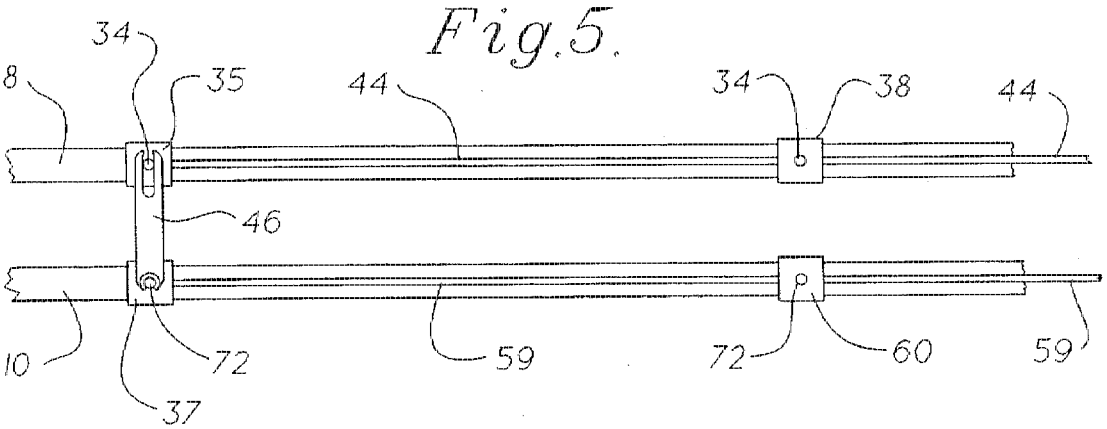
FIG. 5 is a bottom view of an end portion of the tracks of the master carrier.
Figure 10:
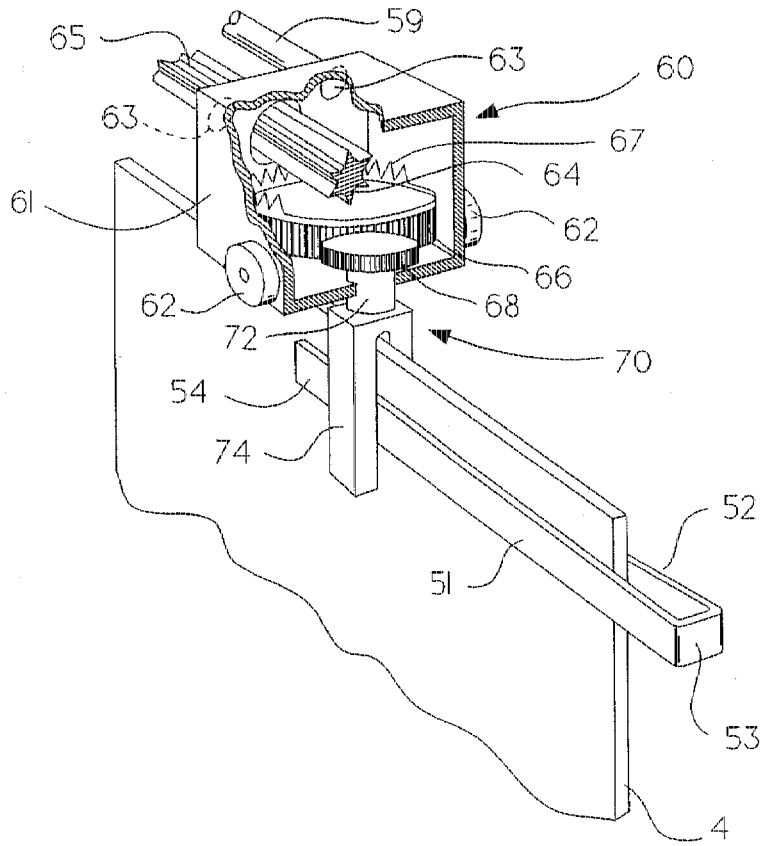
FIG. 10 is a fragmentary view of a vertical vane with a pusher and carrier attached.

A preferred carrier 60 for holding the vanes 4 is shown in FIGS. 3, 4 and 10. A hollow cubical body 61 has wheels 62 attached to opposite sides and a spacer 59 extending from one end. Holes 63 are provided in the body 61 through which the traverse cord passes. The wheels ride in the vertical track 10 shown in FIGS. 1 and 5. A splined shaft 64 extends through the vertical track and passes through each carrier 60 as illustrated in FIGS. 3 and 4. A rack 66 is provided within and at one end of the carrier 60. The top of the rack has teeth 67 which engage splines 65 on shaft 64. Gear teeth 68 are provided on a surface of the rack which engage a gear-like head 69 of pendant 70. A neck 72 extends from the head 69 through the carrier body 61. A U-shaped pendant body 74 is attached to the neck 72 and receives a vane in cavity 73. Protrusions 76 and 77 cooperate with a hole in the vane to retain the vane in the cavity 73. When splined shaft 64 is rotated, rack 66 is moved from side to side causing head 69 to turn thereby tilting the vane attached to the pendant. An auto rotate mechanism or a traverse stop mechanism is preferably provided to prevent the drape and vertical from being traversed when the vanes are not in the open position. The auto rotate mechanism 15 is provided at one end of the track 10 as indicated in FIG. 1. This mechanism turns the splined shaft 64 to an open position whenever an operator pulls the traverse cord 18 to cause the vanes to move along the carrier track 10. The traverse stop prevents the traverse cord from moving until all of the vanes have been tilted to the fully open position. Most of the auto-rotate mechanisms and traverse stops which are widely used and well-known in the industry can be used in the present light controllable drapery system.

As can be seen in FIG. 1, I provide a traverse cord 18 for advancing and retracting the carriers or slides 38 along the vertical carrier track 10 and a chain 19 to rotate the splined shaft. The drapery in FIG. 1 has been cut away to show two of the vertical vanes 45, end vane 14 and a portion of alignment cord 13 which runs along and is attached to the lower portion of the vertical vanes.

Figure 6:
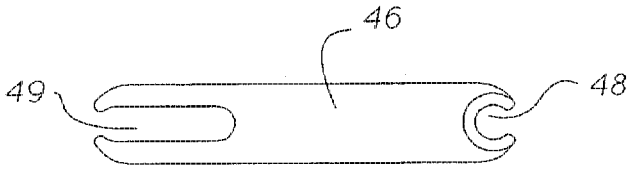
FIG. 6 is a top plan view of a master carrier connector.

I further prefer to provide the connector 46 shown in FIG. 6 between the master carrier slide 37 of the vertical track 10 and the leading carrier 35 on the drapery track 8. The master carrier slide 37 is not necessarily connected to a pendant that has a vane connected to it. As can be seen in FIG. 6 the connector 46 has a mouth 48 which snap fits around the neck of the master vertical vane carrier 37 located in the vertical track 10. A second mouth 49 is provided on the opposite end of the connector 46 to engage the neck 34 of the pendant 30 on the drapery carrier 35 connected to the front edge of the drapery material.

Figure 11:
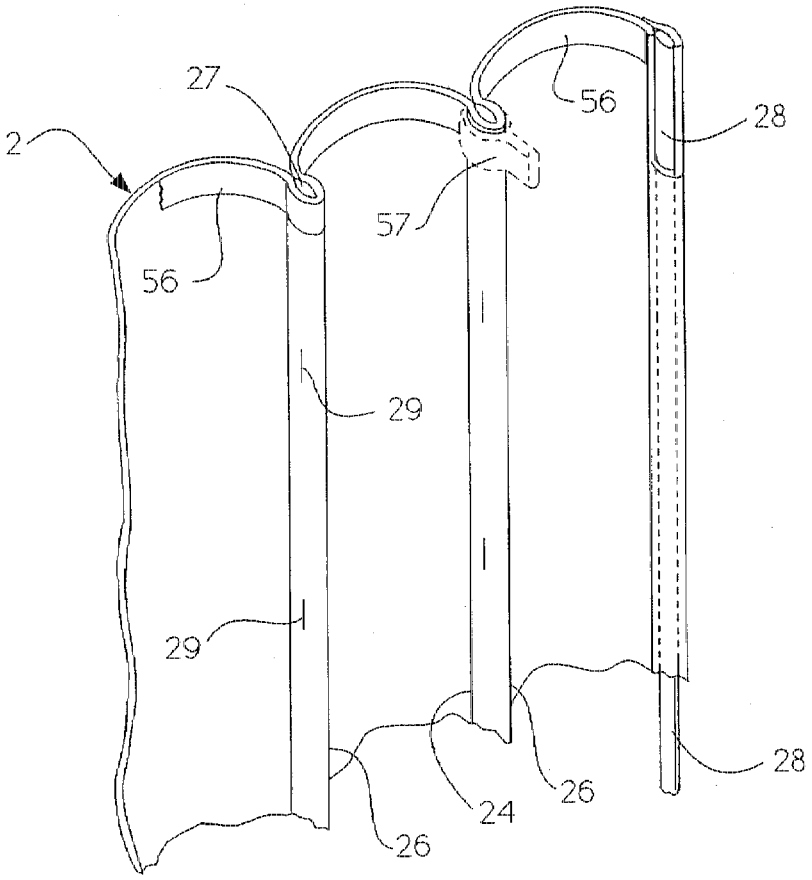
FIG. 11 is a perspective view of a segment of a present preferred drapery.

As shown in FIG. 11, I prefer to provide tabs 26 on the pleats 24 of the drapery material 2. The tabs preferably have a pocket 27 into which a vertical stabilizing rod 28 can be placed. If tabbed fabric is used for the embodiments shown in FIGS. 12 and 13, the tabs would be at least part of the portion 25 of pleat 24 that extends between the vanes. To prevent light from passing between the vanes in the embodiments of FIGS. 12 and 13 strips of opaque material may be placed in the pockets 27 formed in the tabs 26. I also prefer to provide equally spaced apart slits 29 in the tabs. These slits are very helpful in fabricating and packaging the drapery. As can be seen in FIG. 1 a cord, chain, or segments of cord or chain 13 can be passed through slits or holes in the tabs at the bottom of the drapery and connected to the vanes to maintain equal spacing between the drape and the vanes and to maintain the orientation of the drape between the vanes. Cord 13 or another flexible link can connect the drape to the vanes to damp the random motion of the drapes and the vanes caused by wind, people operating the product, or random room air currents.

As shown in FIGS. 7 thru 10 I prefer to provide a pusher 50 on the top of each vane which is either flexible enough or hinged to move from side to side of the vanes with a minimum of pressure from the adjacent vane and stiff enough to push the drape. The pusher is comprised of opposite sides 51 and 52 and a base 53. At least one of the end of sides 51 and 52 opposite the base 53 is connected to the vertical vane 4. Preferably connection is made by attaching portions of the ends of both sides 51 and 52 of the pusher 50 to each side of the vane 4. This can be accomplished with glue, snaps, intertwined holes, or other fasteners. Base 53 is sized to be of a greater length than the thickness of the vanes 4. As can be seen in FIG. 11, I prefer to provide a smooth, continuous surface header 56 such a plastic strip along the top of the drapery material 2. Preferably header 56 is removably attached to the drape 2. Pusher 50 extends outward from a vertical slat 4 to travel along the header surface 56. The pusher rod need not engage the material when the vertical vanes are in an open position. As the vane 4 is rotated pusher 50 causes the adjacent pleat or tab portion of the pleats to advance beyond its open position as can be seen by comparing FIGS. 7, 8 and 9. This prevents the drapery material from becoming caught between the vertical vanes as they are closed. Finally, when the vanes are in a closed position shown in FIGS. 7 and 9 each pusher rod 50 extends over the adjacent vertical vane 4. In this manner, the pushers 50 translate the drape 2 from side to side on the drapery track 8 so that the edges of the vanes do not get caught behind the tabs or the pleats of the drape when the vanes are rotated back to the open position. The vanes have a sufficient width as shown in FIG. 9 to prevent the drape from moving back over the vane from random motion caused by people, pets, wind, or other forces acting on the drapery material. This could also be accomplished by putting a thick extension on the tab of each drape that extends between notches in the vanes or by having a loop comprised of the segments of the spacers provided between the drapery carriers when two drapes are used. A teeter-totter like connector plate and latch on the master carrier combined with a special tilter on the opposite end of the blind pulls the linked drapery carriers in time with the tilt of the vanes.

Although I prefer to mount the pushers on the vanes, the pushers could be attached to the drapery. Those pushers must be sized and positioned to engage an adjacent vertical slat whenever the vertical slat is rotated a desired amount so that rotation of the vertical slat from an open position to a closed position pushes the drapery along the drapery track. In FIG. 11 a pusher 57 is shown in chainline attached to the drapery. In this embodiment a pusher would be attached to the top of the drapery at each pleat. Drapery pushers 57 are more easily attached to the tabs of tabbed drapery such as is shown in FIG. 11 than to untabbed drapery material.

Figure 14:
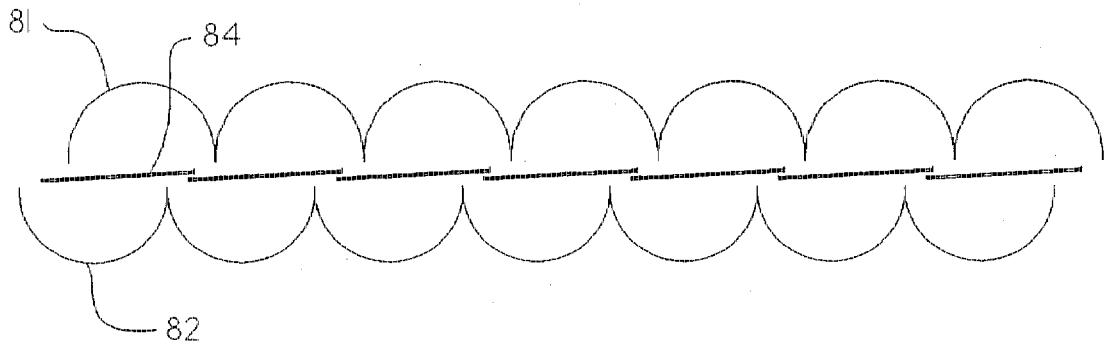
FIG. 14 is a diagram of another present preferred embodiment having a double drape and vertical vanes.

In a fourth preferred embodiment shown in FIG. 14, I provide two drapes 81 and 82 positioned on opposite sides of a set of vertical vanes 84. The drapes are positioned so that opposite drapery pleats are offset as shown.

A variety of drapery materials can be used for the present system. The selected material should have some degree of translucence or even transparency. Sheers and laces work especially well.

Although I have shown several present preferred embodiments of my light controllable drapery system, it should be distinctly understood that the invention is not limited thereto but may be variously embodied within the scope of the following claims.

I claim:

1. A light controllable drapery system comprising:

a. a master carrier comprised of a first track and a second track each track having a plurality of carriers slidable along the track, the first track being parallel to the second track;

b. at least one connector connecting a carrier on the first track to a carrier on the second track to enable carriers on the first track to move concurrently with carriers on the second track;

c. a drapery hung from the carriers on the first track, wherein the drapery has a plurality of vertical pleats each pleat having a length extending the complete vertical length of the drapery and also comprising a tab on each pleat wherein all tabs are on one face of the drapery and extend alone the complete vertical length of the pleat to which the tab is attached;

d. vertical blind vanes hung from the carriers on the second track; and e. a tilt mechanism connected to the vertical vanes for turning the vanes between a closed position and an open position.

2. The light controllable drapery system of claim 1 also comprising a plurality of rods, one rod attached to each tab.

3. The light controllable drapery system of claim 2 wherein the rods are enclosed within the tabs.

4. The light controllable drapery system of claim 1 also comprising a plurality of opaque strips, at least one strip being positioned within each tab.

5. The light controllable drapery system of claim 1 also comprising a flexible link between the vanes and the tabs.

6. The light controllable drapery system of claim 1 also comprised of a pusher attached to each vertical vane the pusher sized and positioned to engage and push an adjacent tab on the drapery whenever the vertical vane is rotated a desired amount.

7. The light controllable drapery system of claim 6 wherein the pushers are attached to the vertical vane near the carriers on the second track.

8. The light controllable drapery system of claim 1 wherein each tab has a plurality of spaced apart slits, all adjacent slits being spaced apart a same distance.

9. The light controllable drapery system of claim 3 also comprising a pusher attached to each tab the pusher sized and positioned to engage an adjacent vertical slat whenever the vertical slat is rotated a desired amount so that rotation of the vertical slat from an open position to a closed position pushes the drapery along the first track.

10. The light controllable drapery system of claim 1 wherein the vertical vanes each rotate about a vertical axis and each vertical axis is opposite a pleat in the drapery such that when the drapery and vanes are fully extended along their respective tracks and the vanes are in an open position, a line passing through any vane and the opposite pleat will bisect the opposite pleat.

11. The light controllable drapery system of claim 1 also comprising a smooth header attached to the drapery.

12. A light controllable drapery system comprising:

a. a master carrier comprised of a first track and a second track each track having a plurality of carriers slidable along the track, the first track being parallel to the second track;

b. at least one connector connecting a carrier on the first track to a carrier on the second track to enable carriers on the first track to move concurrently with carriers on the second track;

c. a drapery hung from the carriers on the first track;

d. vertical blind vanes hung from the carriers on the second track in a manner so that there are pairs of adjacent vanes, wherein the vertical vanes each rotate about a vertical axis, at least some of the vertical axes lie in a vertical plane, and a portion of the drapery extends through the vertical plane and between the vertical axes of each pair of adjacent vanes; and e. a tilt mechanism connected to the vertical vanes for turning the vanes between a closed position and an open position.

13. The light controllable drapery system of claim 11 wherein each vertical vane of each pair of adjacent vanes has a width less than a distance between the pair of adjacent vertical vanes.

14. The light controllable drapery system of claim 12 also comprising a removable header removably attached to the drapery.

15. The light controllable drapery system of claim 12 also comprising a pendant pivotably attached to each carrier on the first track and attached to the drapery.

16. The light controllable drapery system of claim 12 also comprising a pendant pivotably attached to each carrier on the second track and attached to one of the vertical vanes.

17. The light controllable drapery system of claim 12 wherein all adjacent carriers are spaced apart by a same distance.

18. The light controllable drapery system of claim 12 also comprising an auto rotate mechanism connected to the vertical vanes which rotates the vertical vanes to an open position whenever the carriers from which the vanes are hung are traversed along the second carrier track.

19. A light controllable drapery system comprising:

a. a master carrier comprised of a first track and a second track each track having a plurality of carriers slidable along the track, the first track being parallel to the second track;

b. at least one connector connecting a carrier on the first track to a carrier on the second track to enable carriers on the first track to move concurrently with carriers on the second track;

c. a drapery hung from the carriers on the first track, wherein the drapery has a plurality of pleats;

d. vertical blind vanes hung from the carriers on the second track;

e. a tilt mechanism connected to the vertical vanes for turning the vanes, between a closed position and an open position; and f. a pusher attached to each vertical vanes the pusher sized and positioned to engage and push an adjacent pleat on the drapery whenever the vertical vane is rotated a desired amount.

20. The light controllable drapery system of claim 19 wherein the pusher is U-shaped having a first side, a second side and a base attached to a first end of each side, the pusher being sized and positioned so that a portion of each side extends over a corresponding face of the vertical vane to which the pusher is attached, the base having a length greater than a thickness of the vertical vane to which the pusher is attached, at least one side of the pusher being attached to the vertical vane.

21. The light controllable drapery system of claim 19 also comprising a pendant removably attached to each carrier on the first track and attached to the drapery.

22. A light controllable drapery system comprising:

a. a master carrier comprised of a first track and a second track each track having a plurality of carriers slidable along the track, the first track being parallel to the second track;

b. at least one connector connecting a carrier on the first track to a carrier on the second track to enable carriers on the first track to move concurrently with carriers on the second track;

c. a drapery hung from the carriers on the first track, the drapery having a plurality of pleats of a chosen length;

d. vertical blind vanes hung from the carriers on the second track;

e. a tilt mechanism connected to the vertical vanes for turning the vanes between a closed position and an open position; and f. a pusher attached to each end of the plurality of pleats, the pusher sized to have a width less than the chosen length of the pleats and to extend beyond the pleats and to engage an adjacent vertical slat whenever the vertical slat is rotated a desired amount so that rotation of the vertical slat from an open position to a closed position pushes the drapery along the first track.

* * * * *

UNITED STATES PATENT AND TRADEMARK OFFICE

CERTIFICATE OF CORRECTION

PATENT NO. : 5,713,407

DATED : February 3, 1998

INVENTOR(S) : REN JUDKINS

It is certified that error appears in the above-indentified patent and that said Letters Patent is hereby corrected as shown below:

Column 6, line 19, claim 1, change "alone" to --along--.

Signed and Sealed this

Thirty-first Day of March, 1998

*Attest:*

*Attesting Officer*

Bruce Lehman

BRUCE LEHMAN

*Commissioner of Patents and Trademarks*